United States Patent [19]

Beckwith et al.

[11] 3,937,033

[45] Feb. 10, 1976

[54] AIR DEFROST DISPLAY CASE

[75] Inventors: Sterling Beckwith, Menlo Park, Calif.; Robert E. Vogel; William Goyman, both of Marshall, Mich.

[73] Assignee: Kysor Industrial Corporation, Cadillac, Mich.

[22] Filed: Feb. 7, 1975

[21] Appl. No.: 547,817

[52] U.S. Cl. ..... 62/155; 62/156; 62/256; 62/234; 62/282

[51] Int. Cl.[2] ..... F25D 21/06

[58] Field of Search ..... 62/80, 82, 150, 151, 155, 62/156, 256, 282

[56] References Cited

UNITED STATES PATENTS

| | | | |
|---|---|---|---|
| 3,082,612 | 3/1963 | Beckwith | 62/282 |
| 3,369,375 | 2/1968 | Gerweck | 62/256 |
| 3,403,525 | 10/1968 | Beckwith et al. | 62/282 |
| 3,496,732 | 2/1970 | Vogel et al. | 62/155 |
| 3,850,003 | 11/1974 | Beckwith et al. | 62/82 |

*Primary Examiner*—William J. Wye
*Attorney, Agent, or Firm*—Price, Heneveld, Huizenga & Cooper

[57] ABSTRACT

A multiple curtain, refrigerated display case employing an energy saving air defrost system that, during the first defrost stage, draws defrosting ambient air into the refrigerated air curtain passage from both directions, and during the second defrost stage employs part of the defrost air to form a circulating air curtain over the open front of the case. The case has defrost exhaust fans in the upper rear thereof actuated by a timer simultaneously with deactuation of the guard curtain fans and the refrigeration condensing unit. The circulation fans for the refrigerated air of the case have a total propulsive capacity significantly greater than that of the exhaust fans, such refrigerated air circulation fans being upstream of the refrigeration coils in the refrigerated air curtain passage, and the exhaust fans being downstream of such coils.

4 Claims, 4 Drawing Figures

AIR DEFROST DISPLAY CASE

BACKGROUND OF THE INVENTION

This invention relates to air curtain type refrigerated display cabinets, and more particularly to a novel air defrost refrigerated display cabinet.

Multiple air curtain refrigerated display cases or cabinets have, since the pioneering development of such in the late 1950's and early 1960's by E. W. Simons, S. Beckwith, W. Hagen, R. Vogel, and others, gained wide acceptance in the food market industry. Such cabinets provide tremendous advantages in the storage and display of frozen foods and the like. The cabinets generally employ two or three air curtains, with the innermost one and the adjacent one normally being recirculated around the cabinet through passages. The innermost curtain is normally the coldest, the second one being somewhat warmer, and the third outer one being basically an ambient temperature curtain to reinforce the jet inertia and warm the aisle. Refrigeration means, normally in the form of one or more evaporator coil units, is located in the innermost passage for cooling the air flowing past. Periodically during operation, this innermost passage and its refrigeration means must be defrosted to remove accumulated frost on the coil collected from the cooled air and tending to impede the operation of the equipment. On commercial units, such defrosting is usually achieved with electrical heaters adjacent to the coils of the refrigeration means, or in some instances, by passing hot gas through the coils of the refrigeration means. Hot gas defrost is complex, and is practical in only a small percentage of the installations, however. With electrical defrost, the refrigeration operation is temporarily halted, allowing the recirculating air curtain to be warmed by the high voltage electrical heaters. This normally requires special wiring from the compressor room and, because of the high wattage, is normally operated at higher voltage than the rest of the electrical components of the case. The warm air can then melt the frost built up on the evaporator tubes and fins. It is important to melt this frost, as rapidly as possible in order to minimize temperature rise of the frozen food products, and to minimize collection of frost on the frozen food products from the higher humidity in the recirculated warm air. To achieve this rapid defrosting necessitates the use of considerable electrical power, as is understandable, but has been necessary to this time.

Several years ago, some attempts were made to defrost the display cabinet by circulating ambient air through the inlet and coil zones of the inner passage (U.S. Pat. No. 3,082,612), or the inlet, coil, and back zones of the inner passage (U.S. Pat. No. 3,403,525), using internal baffles to block off the discharge end of the passage. Unfortunately, neither of these concepts proved practical and, as a consequence, all of the thousands of multiple curtain display cabinets manufactured use either the electrical defrost or, in a small percentage of cases, the hot gas defrost technique.

More recently, a cabinet was developed which effectively uses air defrosting, as set forth in U.S. Pat. No. 3,850,003, the defrost air traveling through the coils from both ends. Air defrost has significant advantages over hot gas defrost, as well as significant benefits over electrical defrost. Compared to hot gas defrost, air defrost enables the use of less suction and liquid line, less plexiglass dividers between case sections, less suction and liquid line solenoids, less EPR valves, less 3 way valves, and less auxiliary heat or aisle warming because of the ability to use heat from condensing. Compared to electrical defrost, hot air defrost requires no additional cabinet electrical power for defrosting, the defrost time required is less, and the product temperature rise is less. Unfortunately, however, although the energy savings from the unit in U.S. Pat. No. 3,850,003 are very impressive, and undoubtedly would be important over a long period, the added depth of the resulting cabinet enabled only three twelve foot cabinets to be fitted onto a forty foot long shipping trailer rather than six as previously, thereby causing shipping expense to be double. This added expense plus some added manufacturing expense for the novel defrost construction, enabled competitors to spotlight the differential in initial cabinet cost to the customer, and thereby discourage sale of this cabinet.

Therefore, efforts were applied to achieve an effective air defrost case which could be sold at a price comparable to the energy-consuming competitive units, to thus achieve the energy savings beneficial over the long run to the customer and the nation, while preventing the competition from causing such an energy saving case to be shelved as a result of some initial price differential.

SUMMARY OF THE INVENTION

An important object of this invention therefore is to provide a multiple curtain, open front refrigerated display case or cabinet capable of rapid defrosting of the refrigeration means, the inner passage, and the air curtain inlet and outlet nozzle, using ambient air, without the complexities of the hot gas system, without periodically demanding large amounts of electrical power as at present, and without significantly increasing the initial cost or size of the case relative to comparable cases employing hot gas or electrical defrost.

The novel case is defrosted in an excellent manner by ambient air first flowing for a short time into opposite ends of the refrigerated air passage or conduit in opposite directions, and then flowing only in one direction to reestablish a protective curtain across the open front of the case. The total defrost time is as short as or shorter than that required for high energy consumption electrical defrost. Moreover, no additional power consumption is required for defrost, such that total power consumption of the display cabinet is lowered considerably.

During the air defrost function, a timer stops the condensing unit and freon flow to the case, turns on special defrost fans, and stops the guard circuit fans. The defrost fans apply negative pressure, i.e. suction, to both ends of the innermost passage. And, during the initial stages of the defrost operation, defrosting ambient air is drawn into both ends of this innermost passage, in spite of the greater number of air recirculating fans in this innermost passage than the number of defrost fans, because of the air flow resistance past the frosted coils. As the coils become more and more defrosted, the air flow through the outlet nozzle of this innermost passage changes direction from inflow to outflow for the remainder of the defrost period, with a protective envelope air curtain being reestablished around the cabinet. At this changeover time, the greater volume of the recirculating fans partially overrides the pull of the defrost fans, to reestablish a cool air curtain across the front of the case with part of the air discharging out openings at the top of the case. As a result, defrosting time has been found to be shorter and product temperature rise is kept down. During this entire defrost period, air is not circulated through the guard ducts of the case, such that heat is not wasted warming these guard ducts.

Additional objects, advantages and features of the invention will become apparent from the following detailed description and the drawings.

DESCRIPTION OF THE PREFERRED EMBODIMENT

Figure 1:
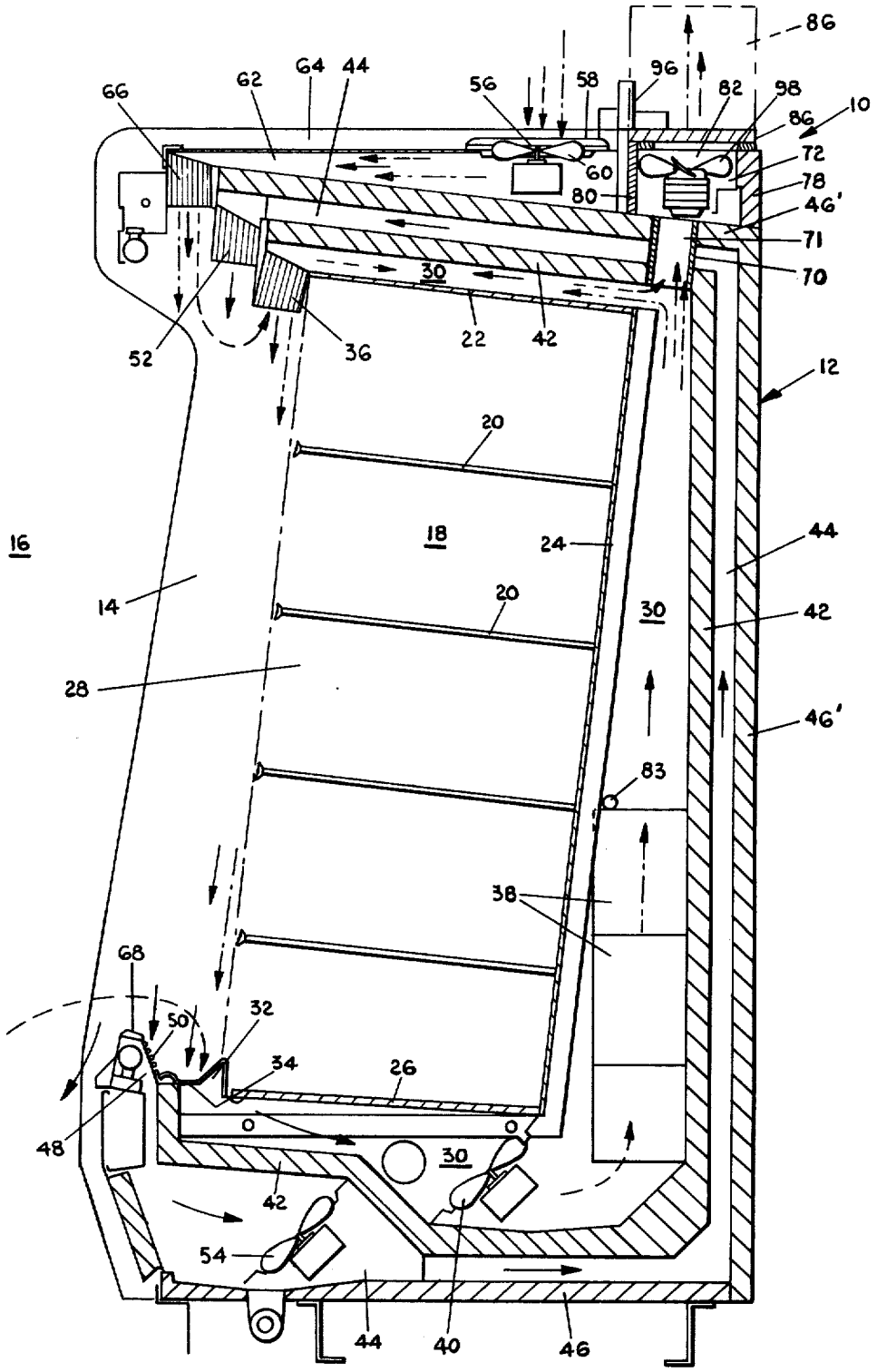
FIG. 1 is a side elevational, sectional view of the novel display cabinet.

Referring now specifically to the drawings, the upright refrigerated display cabinet or case assembly 10 constitutes a housing assembly 12 having an access opening 14 in the front thereof, from the ambient air space 16 about the cabinet to the food storage and display space 18 in the cabinet. This structure is normally placed in a grocery store or supermarket, with display space 18 being divided into sections by a plurality of vertically spaced generally horizontal shelves 20. Space 18 is defined by an upper panel or ceiling 22, a rear panel or wall 24, a bottom panel 26, a pair of end walls 28, and open front 14. Shelves 20 are mounted, preferably adjustably, on suitable uprights at rear wall 24.

Extending around and adjacent the bottom 26, back 24, and top 22 of display area or space 18 is an inner, refrigerated air flow passage or conduit 30 extending substantially along the length of the case. Passage 30 has an elongated, upwardly oriented air flow inlet 32 extending along the lower edge of access opening 14, and normally covered by a perforate, heated grill 34. At the opposite end of the passage, and opposite inlet 32 across open front 14, is a corresponding, elongated air flow outlet nozzle 36, normally containing downwardly oriented, air directing means such as honeycomb as depicted.

Within passage 30, preferably along the lower rear portion thereof, as in the space behind the downwardly, forwardly sloping back panel 24, is evaporator coil means 38 containing the usual tubes and fins, and extending generally along the length of the back panel. Such is shown arranged here in a plurality of three banks, one above the other. This evaporator refrigeration equipment is operably connected with conventional condensing unit equipment external of the display case in usual fashion, e.g. on the roof of the store, in the rear of the store, or the like, as is conventionally done.

Also within passage 30, preferably at the bottom portion of the display case, is a plurality of motor operated fans 40 spaced lengthwise along the display case and acting as air propulsion means to constantly circulate air drawn into inlet 32, past these fans 40, through passage 30, including coils 38, out outlet 36, and down across the open front of the case, i.e. in counterclockwise fashion in the depicted form in FIG. 1, as represented by the solid arrows, to be recirculated. Passage 30 is basically defined between the noted panels 26, 24 and 22 forming one side thereof, and a spaced panel or partition 42 extending around the bottom, back and top of the case to form the other side of the passage. The refrigerated air flowing through passage 30 not only forms an enclosing air curtain in the open front of the case, but a protective envelope around the case. Partition 42 not only forms the outer wall of inner passage 30, but also forms the inner wall of a second adjacent passage 44 which extends around the bottom, back and top of the case outwardly of passage 30, relative to display space 18. The outer wall of passage 44 is formed by bottom panel 46, and back and top panel 46'. Passage 44 includes an elongated inlet 48 adjacent to and outwardly of inlet 32, and having a perforate protective grid or grill 50 thereover. Opposite upwardly opening inlet 48 and adjacent outlet nozzle 36 is a downwardly oriented, elongated outlet nozzle 52 from passageway 44 including air directing means such as honeycomb as depicted. Nozzle 52 is preferably at a small acute angle to nozzle 36. During normal operation, air is circulated through passage 44 by a plurality of motor operated fans 54, preferably in the bottom of the case. Such fans propel air from inlet 48 through passage 44, enveloping the refrigerated air passage 30, and out nozzle 52, to form a protective guard curtain of air contiguous with refrigerated inner air curtain across the open case front, and returning to outlet 48 for recirculation, all as shown by the solid arrows in FIG. 1. During normal operation, the temperature of this recirculated guard air through passage 44 is at a temperature somewhat higher than the temperature of the inner refrigerated air curtain, but below ambient temperature. Fans 54 are spaced longitudinally along the passage to obtain relatively uniform flow along the length of this passage.

A third curtain of air at ambient temperature is preferably also employed, this curtain not being recirculated around the case, but rather entering the case at the top and exiting in front of the rub rail into the aisle. The ambient air for this third curtain enters the case through a plurality of top inlets 56 covered by perforate grids 58, the air being drawn down in by a plurality of motor operated fans 60 spaced longitudinally along the top of case 12. The air is then propelled forwardly through elongated passage 62 between panels 46' and top panel 64, to third outlet nozzle 66 directed downwardly across the open front of the case. It is adjacent nozzle 52 and preferably at a small acute angle relative thereto. This air flow occurs as depicted in the solid lines in FIG. 1. Such air flow, after passage across the open front or access opening 14, basically flows in front of the rub rail 68 at the lower edge of the access opening, and out into the aisle area of the store, so that the ambient air can warm the aisle for customer comfort, as well as adding inertia to the total air curtain.

Basically, the construction described in detail above is the normal construction known previously, the novel features incorporated into the combination being as follows.

Figure 2:
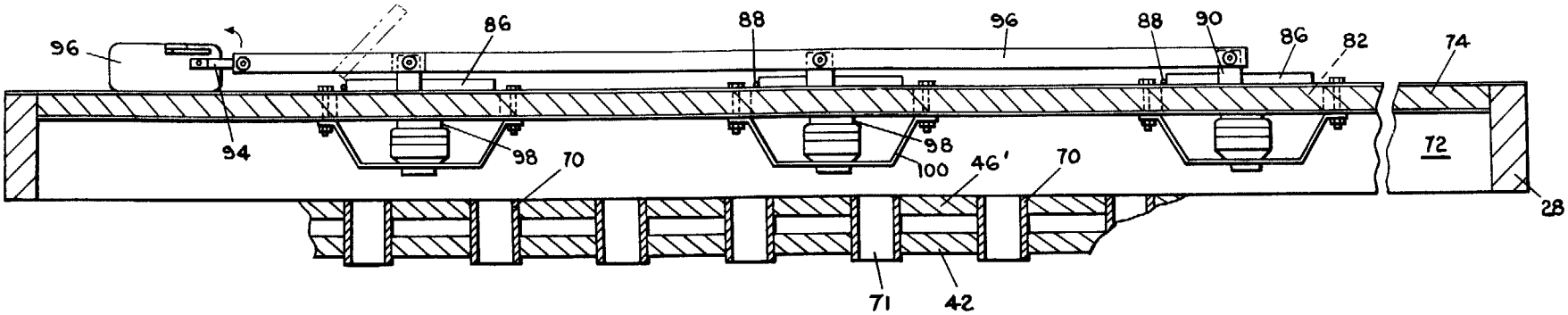
FIG. 2 is a fragmentary, enlarged, sectional view of a portion of the top of the cabinet in FIG. 1, showing the defrost ducts, fans, and doors.
Figure 3:
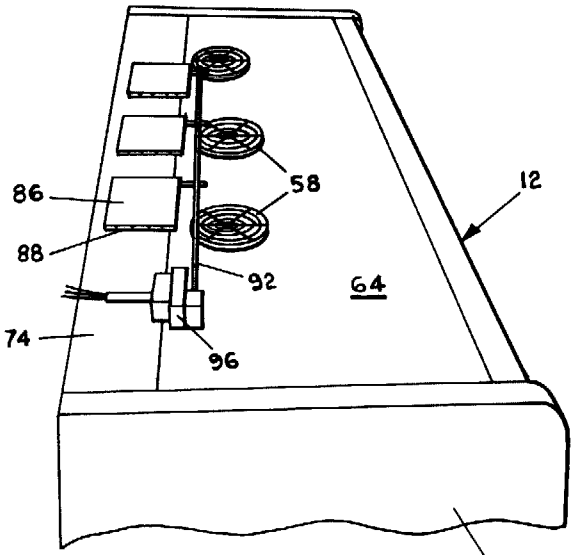
FIG. 3 is a fragmentary perspective view of the top of the cabinet taken from the opposite end as that in FIG. 1.

Extending upwardly through the top rear of the display case, from the upper rear corner of passage 30, is a plurality of vertically oriented, longitudinally spaced hollow sleeves 70, the lower end of each of which communicates with the upper rear portion of passage 30, and the upper end of each of which communicates with an elongated common plenum chamber 72 which extends longitudinally along the top of the display case at the rear thereof. This plenum has a top panel 74, end panels 28 rear panel 78, and front panel 80. A plurality of openings 82 (FIG. 2) extend through top panel 74 from the plenum chamber to the ambient atmosphere above the display case at the rear thereof. These openings are normally closed by a plurality of respective doors 86, each of which is pivotally mounted along a side edge to upper panel 74 by hinges 88 (FIG. 2). Each door has an upstanding bracket 90 attached thereto, all of which brackets 90 are pivotally attached to a common elongated horizontal link 92, one end of which is pivotally connected to a crank 94 of a rotational power gear motor means 96. Thus actuation of the gear motor to shift crank 94 angularly upwardly (to the phantom line position depicted in FIG. 2) draws link 92 and brackets 90 to pivot the plurality of doors 86 simultaneously from a lower closed position, about their hinges 88, to an open up position (depicted by the phantom lines in FIG. 2 for the door on the left). Deactivation of power to gear motor allows the doors to drop back down by gravity bias, supplemented if desired by spring biasing means.

Mounted within plenum 72, and positioned beneath the respective doors 86 at openings 82 are a plurality of respective motor operated exhaust fans 98. These motor operated fans, which may be mounted for example to upper panel 74 by suitable brackets 100, when actuated, serve to draw air from passageway 30, through hollow passages 71 formed by sleeves 70, into plenum 72 and then propel it out openings 82 for exhausting it to the ambient atmosphere.

The total air propulsion capacity of the plurality of exhaust fans 98 taken as a group, is significantly less than the air total propulsion capacity of the plurality of refrigerated air circulating fans 40 taken as a group. This can be readily achieved by having more fans 40 than fans 98, preferably about twice as many. Thus, for example, on a display case eight foot long, there will normally be four fans at 40, and two fans at 98, or, on a twelve foot display case, there will be six fans at 40 and three fans at 98. The results of this difference in propulsion effect will become clear.

The sleeves 70 are spaced sufficiently apart to not seriously affect the flow of guard air through passage 44 through which these sleeves protrude.

Figure 4:
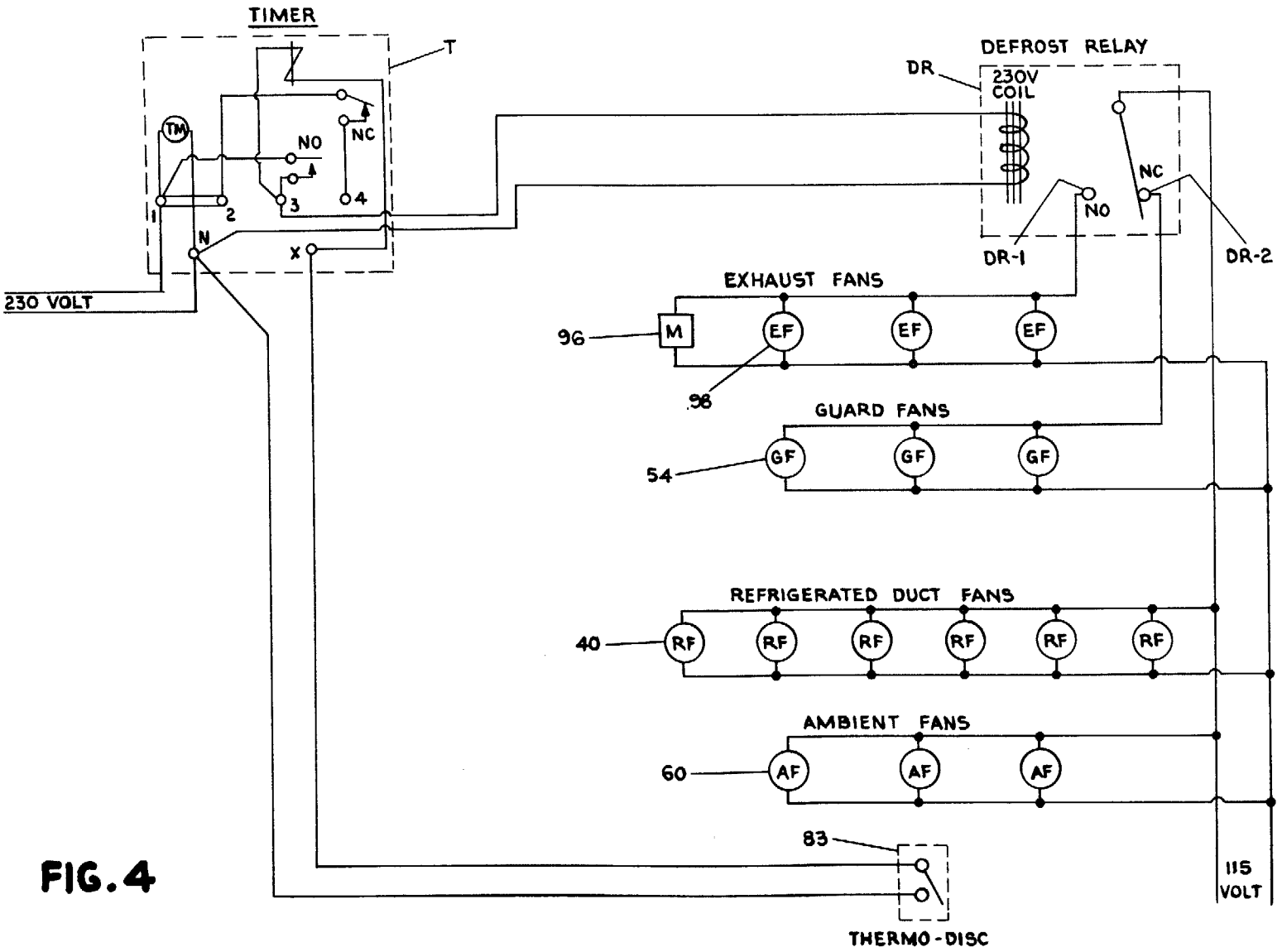
FIG. 4 is a circuit diagram for certain components of the novel case.

In FIG. 4 is depicted a simplified electrical circuit diagram for the defrost control components of the display case, i.e. not including heaters at the honeycomb or at the air inlets, and not including lights and the like which are set forth in detail in previous patents and are now conventional and not a significant part of the invention herein. The depicted circuit includes a conventional timer (shown as T) and defrost relay (shown as DR). The timer T is preset to periodically defrost the refrigeration equipment of the display case a certain number of times per day, e.g. two, three or four, depending on the circumstances. Also shown is a plurality of three motor operated exhaust fan units 98 (shown as EF), gear motor 96 (shown as M), and normally open contacts DR1 of relay DR in series therewith. Also shown is a plurality of three guard fan units 54 (shown as GF) in series with the normally closed contacts DR2 of relay DR. There are also a plurality of six refrigerated air fan units 40 (shown as RF) and a plurality of three ambient air fan units 60 (shown as AF), with units 40 and 60 not being electrically operated by the timer operated relay DR.

During normal operation, when product is displayed in space 18 on shelves 20, air is circulated through passage 30 over coils 38 supplied with refrigerant from the condensing unit, by air propelling fans 40, to flow out nozzle 36, down across the front of the display case in an air curtain form and into return inlet 32. Circulated simultaneously with recirculation of this refrigerated curtain, in the same direction, is the guard air propelled by fans 54, from inlet 48 through passage 44 enveloping the case, around sleeves 70, to outlet 52, and down across the case contiguous with the refrigerated curtain, to inlet 48. And, simultaneously, ambient air is drawn in through inlets 56 by fans 60 and propelled through passage 62 and out honeycomb nozzle 66 across the open front to be discharged in front of the rub rail to the floor area of the aisle. This normal circulation of the inner air curtain and the guard air curtain, and the flow of the ambient air curtain during operation are shown in FIG. 1 by solid line arrows.

Periodically, timer T times out to activate the defrost cycle. Upon timer T activating the defrost cycle, relay DR is activated causing relay contact DR1 to close and contact DR2 to open. When this occurs gear motor M is activated opening doors 86 (FIG. 2), exhaust fans 98 are activated and guard fans 54 are stopped.

The refrigerated air circulating fans 40 and the ambient fans 60 continue to operate. For the first several minutes of the defrost cycle, because of the frost accumulation on the coil, flow of air from fans 40 is restricted and ambient air is pulled into passage 30 (as depicted by the broken line arrow in FIG. 1) by fans 98. The air that does flow past coils 38 and up passage 30 will flow completely up passageways 71 to plenum 72 and exhaust fans 98 which propel it out openings 82 at the top of the case. Simultaneously the drawing or suction effect of the defrost fans causes air to be pulled in a reverse fashion into outlet nozzle 36, basically from the ambient air curtain out of nozzle 66, as shown by the broken line arrow at the top of FIG. 1, in a reverse direction through passage 30 at the top of the case, to flow out passageways 71 to plenum 72 and fans 98 to be discharged out the top of the case. Thus both ends of passage are simultaneously rapidly defrosted while the coils 38 are being gradually defrosted.

After several minutes of this operation during which the ambient air enters both ends of passage 30, this passage is cleared of frost except for portions remaining on the downstream end of coils 38 i.e. on the upper end thereof. At this point, the resistance of warm air flow through the coils drops sufficiently that the greater air propulsive capacity of fans 40 relative to the propulsive capacity of defrost fans 98 causes the volume of air flowing past coils 38 to be greater than the suction of fans 98. Thus, part of this air flows to the exhaust fans and the remainder flows through the top portion of passage 30 and out nozzle 36 in the general flow pattern indicated by the broken dot dash line arrows in FIG. 1. During the remainder of the defrost cycle, some of the defrosting air, cooled somewhat by passage through the air evaporator coils 38, forms a lower velocity protective curtain across the open front of the case, into inlet 32 and back through fans 40 to lessen the warming effect on the product. Once the coil is completely defrosted, thermo disc 83 closes a circuit in the time clock which puts the condensing unit back in operation and de-energizes the coil of the defrost relay DR thereby opening contact DR1 and closing DR2.

During this defrost cycle, no air is circulated through the guard ducts or passage 44 because the guard fan units are not operating. This enables the walls of passage 44 to remain cool. Therefore the walls need not be cooled down again after termination of defrost. And, no heat is lost warming these walls. As a consequence of all of these factors, it has been found that the defrost time can be shortened significantly compared to electrical defrost. In terms of energy savings alone, it has been determined that about 0.93 KWH is saved per day per foot of display case. Moreover, the product quality remains higher because of less temperature rise during the shorter defrost period.

Extensive experimentation with this development has proven it to accomplish significant energy savings over present commercial units, without added cabinet size that would impose shipping problems and without significant added production cost that would inhibit its adoption by stores.

Conceivably, certain minor deviations from the particular preferred depicted embodiment of the inventive concept could be incorporated to suit a particular case configuration, store environment, display product, or the like. Thus, the particular embodiment set forth as illustrative of the novel concept is not intended as a limitation of the concept, which is to be limited only by the scope of the appended claims and the reasonable equivalents thereto.

The embodiments of the invention in which an exclusive property or privilege is claimed are defined as follows:

1. In an upright refrigerated display cabinet having a top, a bottom, a rear, a front side, and an access opening in said front side communicating a storage and display space within the cabinet with the ambient atmosphere, at least two outlets, an inner one and an adjacent one, extending across one edge of said access opening; and corresponding inner and adjacent inlets extending across the opposite edge of said access opening; an inner conduit extending from said inner inlet, around the bottom, back and top of said cabinet, to said inner outlet; an adjacent conduit extending from said adjacent inlet around said cabinet to said adjacent outlet; refrigeration coil means in said inner conduit; a plurality of refrigerated air circulating fans in said inner conduit to propel air from said inner inlet, across said coil means, to said inner outlet, and across said access opening; a plurality of guard air circulating fans in said adjacent conduit; the improvement comprising: exhaust plenum means at the upper rear of said cabinet; exhaust passages extending from said refrigerated air duct, downstream of said coil means, to said exhaust plenum means; ports extending from said exhaust plenum means through said cabinet top; exhaust fan means in said exhaust plenum means oriented to withdraw air from said refrigerated air duct and discharge it out said ports; doors over said ports shiftable between a port-closing position and a port-opening position; power means for shifting said doors to said port opening position; control means operably associated with said guard curtain fans, said exhaust fan means and said power door shifting means, said control means being operable between one condition, for refrigeration, at which said guard curtain fans are actuated, said exhaust fan means is deactuated, and said power door shifting means is not actuated; and a second condition, for defrost, at which said guard curtain fans are deactuated, said exhaust fan means are actuated, and said power door shifting means is actuated to open said ports.

2. The refrigerated display cabinet in claim 1 wherein said plurality of refrigerated air circulating fans have significantly greater capacity than said defrost fan means.

3. In an upright refrigerated display cabinet having a top, a bottom, a rear, a front side, and an access opening in said front side communicating a storage and display space within the cabinet within the ambient atmosphere, at least two outlets, an inner one and an adjacent one, extending across one edge of said access opening; and corresponding inner and adjacent inlets extending across the opposite edge of said access opening; an inner conduit extending from said inner inlet, around the bottom, back and top of said cabinet, to said inner outlet; an adjacent conduit extending from said adjacent inlet around said cabinet to said adjacent outlet; refrigeration coil means in said inner conduit; a plurality of refrigerated air circulating fans in said inner conduit to propel air from said inner inlet, across said coil means, to said inner outlet, and across said access opening; a plurality of guard air circulating fans in said adjacent conduit; the improvement comprising: exhaust plenum means at said cabinet top at the rear thereof; exhaust passages extending from said refrigerated air duct, downstream of said coil means, to said exhaust plenum means; ports extending from said exhaust plenum means through said cabinet top; exhaust fan means in said exhaust plenum means oriented to withdraw air from said refrigerated air duct and discharge it out said ports; doors over said ports shiftable between a port-closing position and a port-opening position; said plurality of refrigerated air circulating fans having sufficiently greater capacity than said defrost fan means such that, during the initial stage of defrost the impeded flow of air from said refrigerated air circulating fans through said coils in a heavily frosted condition enables said exhaust fan means to draw air into said inner outlet, while in the latter stage of defrost the flow of air through said coils partially passes to said exhaust fan means and partially forms a circulating curtain out said inner outlet.

4. The display cabinet in claim 3 including control means operably associated with said guard air circulating fans and said exhaust fan means, for deactivating the former and actuating the latter during defrost, and for activating the former and deactivating the latter during cabinet operation.

* * * * *

UNITED STATES PATENT AND TRADEMARK OFFICE

CERTIFICATE OF CORRECTION

PATENT NO. : 3,937,033

DATED : February 10, 1976

INVENTOR(S) : Sterling Beckwith, Robert E. Vogel, William Goyman

It is certified that error appears in the above-identified patent and that said Letters Patent are hereby corrected as shown below:

Column 2, line 2:

"or" should be ---for---

Column 8, line 19:

"within" (second occurrence) should be ---with---

Signed and Sealed this

*twenty-fifth* Day of *May 1976*

[SEAL]

*Attest:*

RUTH C. MASON
*Attesting Officer*

C. MARSHALL DANN
*Commissioner of Patents and Trademarks*